US006863016B2

(12) United States Patent
Biemiller

(10) Patent No.: US 6,863,016 B2
(45) Date of Patent: Mar. 8, 2005

(54) APPARATUS AND METHOD FOR STORING AND ACCESSING PERSONAL FLOATATION DEVICES AND/OR OTHER ARTICLES

(76) Inventor: Scott M. Biemiller, 2100 Habersham Marina Rd., Unit 300C, Cumming, GA (US) 30041

( * ) Notice: Subject to any disclaimer, the term of this patent is extended or adjusted under 35 U.S.C. 154(b) by 0 days.

(21) Appl. No.: 10/322,897

(22) Filed: Dec. 18, 2002

(65) Prior Publication Data

US 2003/0089294 A1 May 15, 2003

(51) Int. Cl.[7] ..... B63B 17/00
(52) U.S. Cl. ..... 114/361; 114/343
(58) Field of Search ..... 114/361, 343, 114/364, 190, 71; 441/80, 88, 42; 296/37.8; 224/281

(56) References Cited

U.S. PATENT DOCUMENTS 3,675,257 A * 7/1972 Haglund et al. ..... 441/80
4,498,879 A * 2/1985 Burr ..... 441/80
6,231,111 B1 * 5/2001 Carter et al. ..... 296/146.15
6,327,993 B1 * 12/2001 Richens, Jr. ..... 114/361
6,357,379 B1 * 3/2002 Murphy, Jr. ..... 114/361

* cited by examiner

*Primary Examiner*—Ed Swinehart
(74) *Attorney, Agent, or Firm*—Ashish D. Patel; Joel D. Myers; Myers & Kaplan, LLC

(57) ABSTRACT

An apparatus and method for storing and accessing personal floatation devices and/or other articles, wherein the device permits the elevated storage of personal floatation devices and/or other articles aboard an aquatic vessel, thus reducing deck clutter and/or untidiness, and preserving structural and functional integrity of the personal floatation devices via their removal from long-term subjection to undesirably moist, oily and/or dirty deck surface areas and/or corners.

16 Claims, 7 Drawing Sheets

APPARATUS AND METHOD FOR STORING AND ACCESSING PERSONAL FLOATATION DEVICES AND/OR OTHER ARTICLES

TECHNICAL FIELD

The present invention relates generally to storage devices, and more specifically to an apparatus and method for storing and accessing personal floatation devices and/or other articles. The present invention is particularly suitable for, although not strictly limited to, storing life vests in an elevated position beneath the T-top of a boat, or any hard and/or fixed top of an aquatic vessel.

BACKGROUND OF THE INVENTION

According to the U.S. Coast Guard, more than 90% of deaths associated with boating are from drowning accidents, wherein 80% of those drowning victims failed to wear a personal floatation device. A personal floatation device is specifically designed to maintain a wearer's head above water in a position that permits proper breathing. Although many states possess laws that prohibit the operation of vessels on waters without a personal flotation device on board for each person on the vessel, many boaters typically fail to obey state law for a variety of reasons. One such reason often resides in the inaccessibility of a personal floatation device, and more so, the inaccessibility of a personal floatation device for each person on board the water vessel.

Specifically, many boaters typically fail to equip their vessel with the appropriate number of personal floatation devices. Furthermore, the personal floatation devices that the boaters may have on board, are usually strewn about the deck of the boat, or placed into a corner for an excessive period of time, thus consuming otherwise useable deck surface area, and subjecting the personal floatation devices to undesirable conditions that have a destructive impact upon the structural, and therefore, functional, integrity of the personal floatation devices.

As such, to ensure proper future functional operation of a personal floatation device, wet personal floatation devices must always be permitted to thoroughly air-dry prior to storage, and/or must be maintained within a substantially moisture-free environment during periods of non-use. Therefore, the continued subjection of a personal floatation device, during its dormancy, to a wet or watery boat deck, or an oily, greasy, dirt-ridden corner, has the obvious effect of hindering the drying thereof, resulting in the development of mildew, rot, leaks, reduced strap strength, and/or the hardening of internal filling, thus causing the personal floatation device to deteriorate and lose buoyancy. Moreover, the effective buoyancy of a personal floatation device can further be substantially reduced when subjected to excessive compression via the placement of heavily weighted items and/or the repetitive stepping thereon, causing the internal filling to crush.

Although mesh net-type storage hammocks are available to contain personal floatation devices aboard a vessel in an elevated position, such devices possess inherent disadvantages that make their use highly impractical, inefficient and problematic. Specifically, such devices are typically too cumbersome for efficient and effective installation and/or use, wherein the net-like fabric thereof often becomes entangled with the securing straps of the personal floatation devices, thus hindering expeditious removal of personal floatation devices therefrom in emergency situations.

Therefore, it is readily apparent that there is a need for an apparatus and method for storing and accessing personal floatation devices and/or other articles, wherein the device provides for the elevated storage of personal floatation devices and/or other articles aboard an aquatic vessel, thus increasing useable deck surface area, and sustaining structural and functional stability of the personal floatation devices by reducing their length of exposure to harsh and/or unfavorable environments.

BRIEF SUMMARY OF THE INVENTION

Briefly described, in a preferred embodiment, the present invention overcomes the above-mentioned disadvantages and meets the recognized need for such a device by providing an apparatus and method for storing and accessing personal floatation devices and/or other articles, wherein the device permits the elevated storage of personal floatation devices and/or other articles aboard an aquatic vessel, thus reducing deck clutter and/or untidiness, and preserving structural and functional integrity of the personal floatation devices via their removal from long-term subjection to undesirably moist, oily and/or dirty deck surface areas and/or corners.

According to its major aspects and broadly stated, the present invention in its preferred form is an apparatus and method for storing and accessing personal floatation devices and/or other articles, having, in general, a housing, a closure flap, handles and securing straps.

More specifically, the present invention is an apparatus and method for storing and accessing personal floatation devices and/or other articles, having a compartmentalized housing dimensioned to receive a variety of personal flotation devices therein, wherein the housing is closed off via a closure flap preferably removably secured thereover via a hook-and-loop fastening mechanism. The closure flap preferably possesses handles thereon for the quick detachment of the closure flap from the hook-and-loop fastening mechanism, thus providing expeditious access to the personal floatation devices and/or other articles carried within the housing. The entire housing is preferably securely removably fastened to the underside of a T-top of a boat, and/or other similar elevated structures of a boat, via the attached securing straps, wherein the securing straps possess buckles and/or similar mechanisms that preferably permit adjustment and/or tightening of the securing straps, thus ensuring the secured fastening of the housing to the chosen structure.

A feature and advantage of the present invention is its ability to accommodate offshore lifejackets.

A feature and advantage of the present invention is its ability to accommodate near shore lifejackets.

A feature and advantage of the present invention is its ability to accommodate any type of personal flotation device.

A feature and advantage of the present invention is its ability to accommodate throwable personal floatation devices, including, but not limited to, ring buoys, boat cushions and/or horseshoe buoys.

A feature and advantage of the present invention is its ability to accommodate special use personal floatation devices including, but not limited to, deck suits, work vests and/or hybrids.

A feature and advantage of the present invention is its ability to accommodate a variety of articles in addition to, or in substitution of, personal floatation devices, including, but not limited to, fishing equipment, blankets, clothing, safety kits, fishing belts, fishing nets, and/or the like.

A feature and advantage of the present invention is its ability to increase overall onboard storage capacity.

A feature and advantage of the present invention is its ability to free-up cabin locker space, thus increasing overall onboard storage capacity.

A feature and advantage of the present invention is its ability to be removably secured to any type of T-top of any type of aquatic vessel.

A feature and advantage of the present invention is its ability to be removably secured to any type of hard and/or fixed top of an aquatic vessel.

A feature and advantage of the present invention is its ability to store personal floatation devices and/or other articles aboard an aquatic vessel at an elevated position, thus preserving structural and functional integrity of the personal floatation devices via their removal from long-term subjection to undesirably moist, oily and/or dirty deck surface areas and/or corners.

A feature and advantage of the present invention is its ability to reduce deck clutter and/or untidiness, thus increasing overall useable deck surface area.

A feature and advantage of the present invention is its ability to permit the ventilation of the personal floatation devices and/or articles stored therein via the inherent breathability of the material utilized to construct the device.

A feature and advantage of the present invention is its ability to house a plurality of personal floatation devices.

A feature and advantage of the present invention is its durability.

A feature and advantage of the present invention is its simplicity of design.

A feature and advantage of the present invention is its portability.

A feature and advantage of the present invention is its ability to be easily installed.

These and other objects, features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structures and refer to like elements throughout, and in which.

DETAILED DESCRIPTION OF THE PREFERRED AND ALTERNATIVE EMBODIMENTS

In describing the preferred and selected alternate embodiments of the present invention, as illustrated in FIGS. 1–7, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
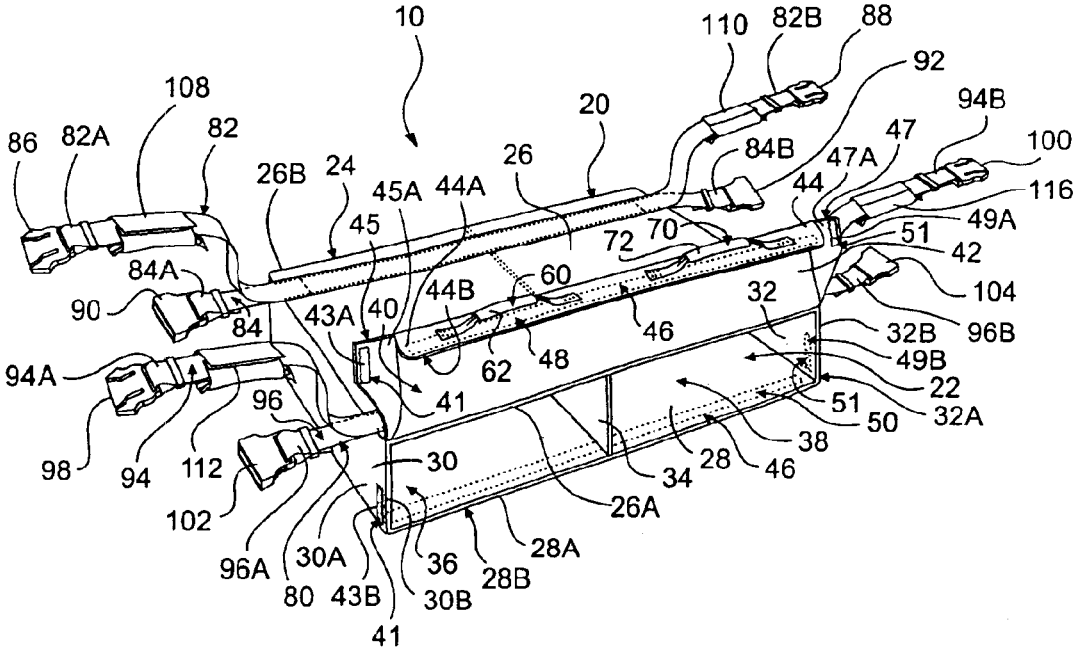
FIG. 1 is a perspective view of an apparatus for storing and accessing personal floatation devices and/or other articles according to a preferred embodiment of the present invention.

Referring now to FIG. 1, the present invention in a preferred embodiment is an apparatus 10, wherein apparatus 10 is an apparatus and method for storing and accessing personal floatation devices and/or other articles, having, in general, housing 20, closure flap 40, handles 60 and 70, and securing strap assembly 80.

Specifically, housing 20 is preferably substantially rectangular-shaped, possessing front aperture 22, rear wall 24, upper wall 26, lower wall 28, first sidewall 30 and second sidewall 32, wherein rear wall 24, upper wall 26, lower wall 28, first sidewall 30 and second sidewall 32 are preferably adjoined via sewing or stitching and/or fixedly attached to one another via any other suitable attaching means, as known within the art, such as, for exemplary purposes only, riveting, hot melt, permanent adhesives and/or via integral formation. Housing 20 is preferably formed from a durable, pliable, breathable nylon fabric, wherein the nylon fabric is preferably lightly coated with a urethane polymer for purposes of wind resistance. Although nylon fabric is preferably utilized to construct housing 20, it is contemplated in an alternate embodiment that housing 20 could be formed from any other suitable material, such as, for exemplary purposes only, cotton, canvas material, mesh materials, textile fabric blends, breathable polyolefin plastics, plastic generally and/or metals for purposes of rigidity. As more fully detailed below, housing 20 is preferably dimensioned to facilitate the storage of four life vests therewithin; however, it is contemplated in an alternate embodiment that housing 20 could be dimensioned to receive any number, size and/or type of personal floatation device.

Preferably, a substantially rectangular-shaped divider 34 is centrally positioned between upper wall 26 and lower wall 28, disposed parallel to first sidewall 30 and second sidewall 32, and extends from rear wall 24 to front edge 28A of lower wall 28, wherein divider 34 is preferably sewn or stitched to upper wall 26 and lower wall 28, or fixedly attached thereto via any other suitable attaching means, as known within the art, such as, for exemplary purposes only, riveting, hot melt, permanent adhesives and/or integrally formed therewith. Divider 34 is preferably formed from a durable, pliable, nylon fabric; although other suitable material could be utilized, such as, for exemplary purposes only, cotton, canvas material, mesh materials, textile fabric blends, breathable polyolefin plastics, plastic generally, cardboard, wood and/or metals for purposes of rigidity. Preferably, divider 34 functions to compartmentalize housing 20, forming first compartment 36 and second compartment 38, thereby permitting the organized receipt and double-stacking of personal flotation devices therein and therethrough via aperture 22, as more fully described below. Preferably, first compartment 36 and second compartment 38 are each dimensioned to receive two conventional off-shore or near-shore life vests, thus facilitating the total storage of four life vests within housing 20. As more fully detailed below, it is contemplated in an alternate embodiment that first compartment 36 and second compartment 38, and/or housing 20 in general, could be dimensioned to receive any number, size and/or type of personal floatation device therein.

Although divider 34 is preferably fixedly attached to upper wall 26 and lower wall 28, it is contemplated in an alternate embodiment that divider 34 could be removably secured therebetween via any suitable securing means as known within the art, such as, for exemplary purposes only, snap-button mechanism, hook-and-loop fasteners, zippers, slots, slide channels and/or the like, thus facilitating expansion and/or non-compartmentalization of housing 20.

Preferably extending from, and integrally formed with, front edge 26A of upper wall 26 is closure flap 40, wherein closure flap 40 is preferably substantially trapezoidal-shaped and possesses front wall 42 having lip 44 and side flaps 45 and 47 extending therefrom. Preferably, closure flap 40 functions, and is dimensioned to, completely close off aperture 22 of housing 20, thereby shielding personal flotation devices stored therein from harsh weather implements. Although closure flap 40 is preferably integrally formed with upper wall 26 of housing 20, it is contemplated in an alternate embodiment that closure flap 40 could be affixed thereto via any suitable affixing means as known within the art, such as, for exemplary purposes only, sewing, stitching, riveting, hot melt and/or permanent adhesives. Closure flap 40 is preferably formed from a durable, pliable, breathable nylon fabric, wherein the nylon fabric is preferably lightly coated with a urethane polymer for purposes of wind resistance. Although nylon fabric is preferably utilized to construct closure flap 40, it is contemplated in an alternate embodiment that closure flap 40 could be formed from any other suitable material, such as, for exemplary purposes only, cotton, canvas material, mesh materials, textile fabric blends, breathable polyolefin plastics, plastic generally and/or metals for purposes of rigidity. It is contemplated in yet another alternate embodiment that closure flap 40 could be removably secured to front edge 26A of upper wall 26 via any suitable securing means as known within the art, such as, for exemplary purposes only, snap-button mechanism, hook-and-loop fasteners, zippers and/or the like, thus facilitating the complete removal of closure flap 40 therefrom.

Preferably, underside 44B of lip 44 of closure flap 40 preferably possesses hook portion 48 of hook-and-loop fastening mechanism 46, wherein loop portion 50 of hook-and-loop fastening mechanism 46 is disposed on underside 28B of lower wall 28, proximal front edge 28A also of lower wall 28. Hook-and-loop fastening mechanism 46 is preferably utilized as the closure mechanism due to its inherent ability to be quickly unfastened, thus permitting expeditious access to the contents of housing 20. As such, to effectuate closure of aperture 22 of housing 20, closure flap 40 is preferably moved downwardly so that front wall 42 thereof is brought over aperture 22, whereupon lip 44 is brought under front edge 28A of lower wall 28 of housing 20, thus permitting hook portion 48 of hook-and-loop fastening mechanism 46 to securely engage loop portion 50 also of hook-and-loop fastening mechanism 46. Although hook-and-loop fastening mechanism 46 is preferably utilized to effectuate closure of closure flap 40 over aperture 22 of housing 20, it is contemplated in yet another alternate embodiment that other suitable closure mechanisms could be utilized, such as, for exemplary purposes only, zippers, snap-button mechanisms, buckles and/or straps.

Preferably side flaps 45 and 47 of closure flap 40 function to permit complete enclosure of personal floatation devices housed within housing 20. Preferably, underside 45A of side flap 45 possesses hook portion 43A of hook-and-loop fastening mechanism 41, wherein loop portion 43B of hook-and-loop fastening mechanism 41 is disposed on outer surface 30A of first sidewall 30 of housing 20, proximal front edge 30B also of first sidewall 30. Similarly, underside 47A of side flap 47 preferably possesses hook portion 49A of hook-and-loop fastening mechanism 51, wherein loop portion 49B of hook-and-loop fastening mechanism 51 is disposed on outer surface 32A of second sidewall 32 of housing 20, proximal front edge 32B also of second sidewall 32. Hook-and-loop fastening mechanisms 41 and 51 are also preferably utilized as closure mechanisms due to their inherent ability to be quickly unfastened, thus permitting expeditious access to the contents of housing 20. As such, to complete the closure process of aperture 22 of housing 20, following the secured engagement of lip 44 of closure flap 40 to lower wall 28 of housing 20 via hook-and-loop fastening mechanism 46, side flaps 45 and 47 are brought into secured contact with first sidewall 30 and second sidewall 32, respectively, of housing 20 via hook-and-loop fastening mechanisms 41 and 51, respectively. Although hook-and-loop fastening mechanism 41 and 51 are preferably utilized to effectuate full closure of closure flap 40 over aperture 22 of housing 20, it is contemplated in yet another alternate embodiment that other suitable closure mechanisms could be utilized, such as, for exemplary purposes only, zippers, snap-button mechanisms, buckles and/or straps.

Preferably affixed to front surface 44A of lip 44 of closure flap 40, opposite underside 44B also of lip 44, are handles 60 and 70, wherein handles 60 and 70 are preferably affixed thereto via any suitable affixing means as known with the art, such as, for exemplary purposes only, sewing, stitching, riveting, hot melt, permanent adhesives and/or integrally formed therewith. Preferably, handles 60 and 70 function to permit quick detachment of hook portion 48 from loop portion 50 of closure flap 40 in general, thus providing expeditious access to the personal floatation devices and/or other articles carried within first compartment 36 and second compartment 38 of housing 20. Handles 60 and 70 further preferably possess textured grips 62 and 72 to facilitate expeditious grasping and opening of closure flap 40 from aperture 22 of housing 20.

Figure 2:
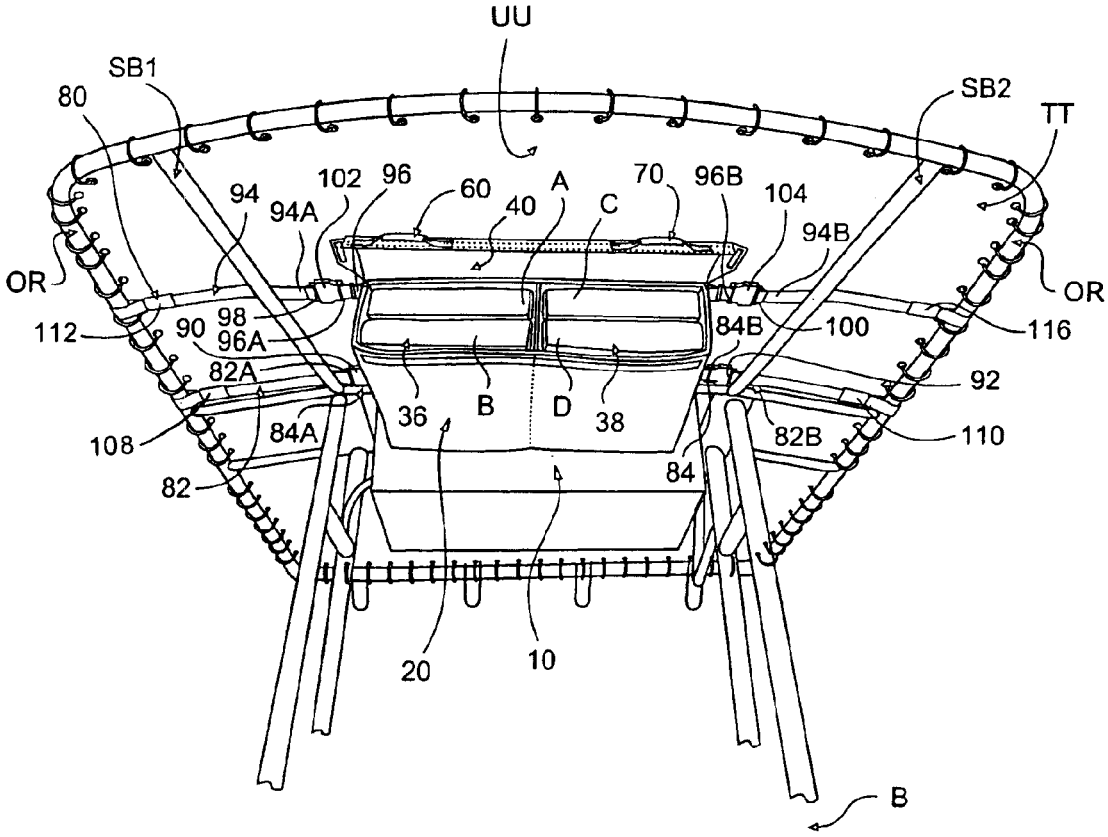
FIG. 2 is a perspective view of an apparatus for storing and accessing personal floatation devices and/or other articles according to a preferred embodiment of the present invention, showing the device in use.
Figure 3:
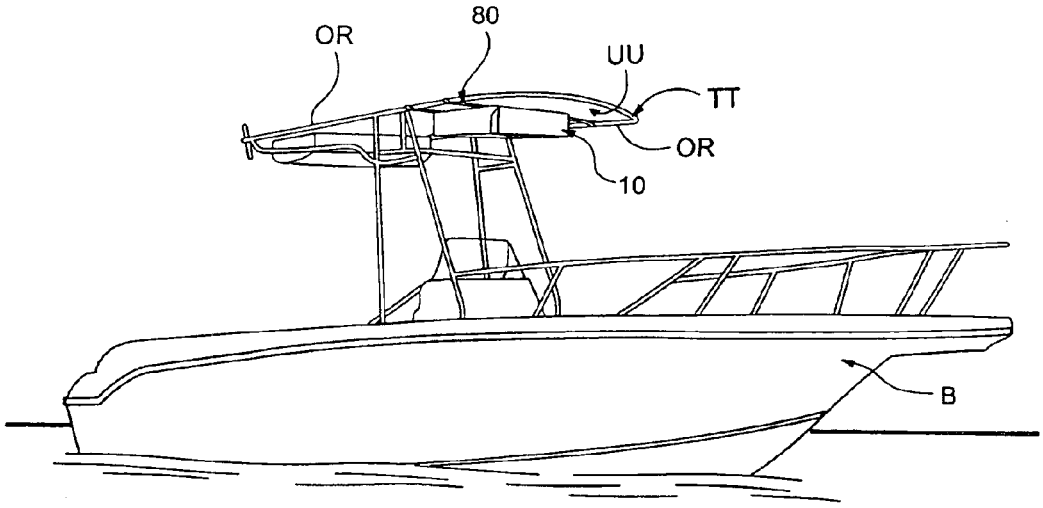
FIG. 3 is a perspective view of an apparatus for storing and accessing personal floatation devices and/or other articles according to a preferred embodiment of the present invention, showing the device in use.

Referring now more specifically to FIGS. 1–3, securing strap assembly 80 is preferably utilized to secure housing 20, and device 10 in general, to underside U of T-top TT of boat B. In contemplation of securing strap assembly 80, as fully detailed below, it should be recognized by those skilled in the art, that for purposes of durability and effective support, the straps of securing strap assembly 80 are preferably formed from a durable nylon webbing, and/or any other suitable material, such as, for exemplary purposes only, plastic, metal mesh, or the like. Specifically, securing strap assembly 80 preferably possesses first strap 82 in overlying relationship with second strap 84, wherein first strap 82 and second strap 84 are preferably positioned proximal to, and parallel with, second edge 26B of upper wall 26 and securely stitched thereto and/or affixed thereon via any suitable affixing means as known with the art, such as, for exemplary purposes only, sewing, riveting, hot melt, permanent adhesives and/or integrally formed therewith. Preferably, first strap 82 is of a continuous length, possessing first end 82A and second end 82B, wherein ends 82A and 82B preferably possess slidably adjustable male fastening mechanisms 86 and 88, respectively, preferably of the prong-type male fastening mechanisms as known within the art; however, other suitable male fastening mechanisms capable of being adjusted along first strap 82 could also be utilized.

Preferably, second strap 84 is sectionalized, possessing first sectional end 84A and second sectional end 84B, wherein ends 84A and 84B preferably possess fixed female fastening mechanisms 90 and 92, respectively, preferably of the receiver-type female fastening mechanisms that preferably permit cooperative engagement with prong-shaped male fastening mechanisms 86 and 88, respectively, of first strap 82. Although female fastening mechanisms 90 and 92 are preferably fixed at ends 84A and 84B, respectively, of second strap 84, it is contemplated in an alternate embodiment that female fastening mechanisms 90 and 92 could also be adjustable, and could further be any other type of female fastening mechanisms capable of cooperatively engaging with male fastening mechanisms as known within the art.

Preferably, first strap 82 is substantially longer, in general, than second strap 84 for purposes of being adjustably extended to, and securely engaged with, the structural frame of T-top TT via cooperative engagement of adjustable male fastening mechanisms 86 and 88 with fixed female fastening mechanisms 90 and 92, respectively, as more fully described below.

Similarly, securing strap assembly 80 also preferably possesses third strap 94 in overlying relationship with fourth strap 96, wherein third strap 94 and fourth strap 96 are preferably positioned proximal to, and parallel with, first edge 26A of upper wall 26 and securely stitched thereto and/or affixed thereon via any suitable affixing means as known with the art, such as, for exemplary purposes only, sewing, riveting, hot melt, permanent adhesives and/or integrally formed therewith. Preferably, third strap 94 is of a continuous length, possessing first end 94A and second end 94B, wherein ends 94A and 94B preferably possess slidably adjustable male fastening mechanisms 98 and 100, respectively, preferably of the prong-type male fastening mechanisms as known within the art; however, other suitable male fastening mechanisms capable of being adjusted along third strap 94 could also be utilized.

Preferably, fourth strap 96 is sectionalized, possessing first sectional end 96A and second sectional end 96B, wherein ends 96A and 96B preferably possess fixed female fastening mechanisms 102 and 104, respectively, preferably of the receiver-type female fastening mechanisms that preferably permit cooperative engagement with prong-shaped male fastening mechanisms 98 and 100, respectively, of third strap 94. Although female fastening mechanisms 102 and 104 are preferably fixed at ends 96A and 96B, respectively, of fourth strap 96, it is contemplated in an alternate embodiment that female fastening mechanisms 102 and 104 could also be adjustable, and could further be any other type of female fastening mechanisms capable of cooperatively engaging with male fastening mechanisms as known within the art.

Similarly, third strap 94 is preferably substantially longer, in general, than fourth strap 96 for purposes of being adjustably extended to, and securely engaged with, the structural frame of T-top TT via the cooperative engagement of adjustable male fastening mechanisms 98 and 100 with fixed female fastening mechanisms 102 and 104, respectively, as more fully described below.

As best illustrated in FIGS. 2–3, to secure device 10 to underside U of T-top TT, ends 82A and 82B of first strap 82 preferably extend outwardly from housing 20, are brought over, or under, opposing inner support bars SB1 and SB2, respectively, and are looped over and around opposing sides of outer ring OR, wherein male fastening mechanisms 86 and 88 of first strap 82 are thereafter brought into secured cooperative engagement with female fastening mechanisms 90 and 92, respectively, of second strap 84. Male fastening mechanisms 86 and 88 may be slidably adjusted along first strap 82 to accommodate for a variety of differently sized/spaced outer rings of different T-tops. Due to the substantially long length of first strap 82, any extra slack of first strap 82 at ends 82A and 82B thereof, is preferably tidily folded and maintained within bandages 108 and 110, respectively, wherein securement wraps or bandages 108 and 110 preferably possess hook-and-loop fastening mechanisms to permit their removable securement therefrom.

Similarly, ends 94A and 94B of third strap 94 preferably extend outwardly from housing 20, are brought over, or under, opposing inner support bars SB1 and SB2, respectively, and are looped over and around opposing sides of outer ring OR, wherein male fastening mechanisms 98 and 100 of third strap 94 are thereafter brought into secured cooperative engagement with female fastening mechanisms 102 and 104, respectively, of fourth strap 96. Male fastening mechanisms 98 and 100 may be slidably adjusted along third strap 94 to accommodate for a variety of differently sized/spaced outer rings of different T-tops. Due to the substantially long length of third strap 94, any extra slack of third strap 94 at ends 94A and 94B thereof, is preferably tidily folded and maintained within bandages 112 and 116, respectively, wherein securement wraps or bandages 112 and 116 preferably possess hook-and-loop fastening mechanisms to permit their removable securement therefrom.

Although the aforementioned method of installation entails installing/securing device 10 to underside U of T-top TT, it should be recognized by those skilled in the art, that device 10 could be adapted to any type of aquatic vessel T-top, hard top, fixed top, bimini top, canopy, and/or any other overhead covering, as known within the art. It is further contemplated that device 10 could be adapted to most any surface structure of an aquatic vessel.

As is apparent from the functional design of device 10, male fastening mechanism 86, 88, 98 and 100 are preferably releasable from female fastening mechanisms 90, 92, 102 and 104 to permit the rapid removal and transport of device 10.

As further detailed in FIG. 2, life vests A and B are preferably in a stacked formation and stored within first compartment 36, wherein life vests C and D are also preferably in a stacked formation and stored with second compartment 38. It is contemplated in an alternate embodiment that any type, size, form and/or number of personal flotation devices could be stored within housing 20.

Although first strap 82 and third strap 94 are preferably continuous length straps, and second strap 84 and fourth strap 96 are preferably sectionalized straps, it is contemplated in an alternate embodiment that first strap 82 and third strap 94 could either be continuous or sectionalized straps, and that second strap 84 and fourth strap 96 could also either be continuous or sectionalized straps. It is further contemplated in an alternate embodiment that first strap 82, second strap 84, third strap 94 and fourth strap 96 could be affixed to different walls and/or areas of housing 20 to facilitate attachment of device 10 to any aspect of the vessel's structure. In yet another alternate embodiment, it is contemplated that male fastening mechanisms 86, 88, 98 and 100 and female fastening mechanisms 90, 92, 102 and 104 could be reversed on their respective straps, such that male fastening mechanisms 86, 88, 98 and 100 would be fixed, and female fastening mechanisms 90, 92, 102 and 104 would be adjustable.

Figure 4:
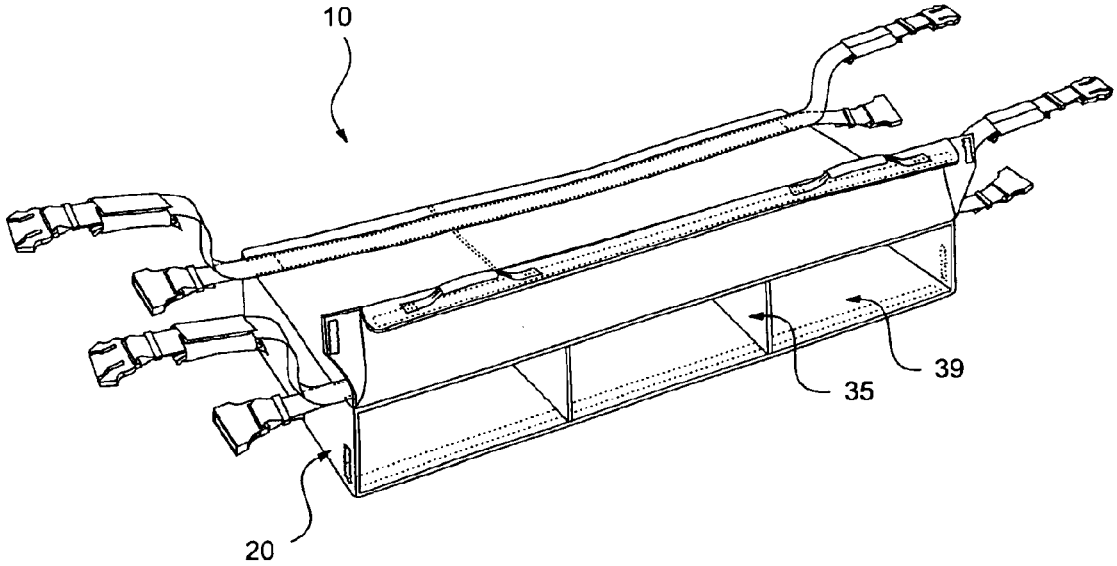
FIG. 4 is a perspective view of an apparatus for storing and accessing personal floatation devices and/or other articles according to an alternate embodiment of the present invention.

Referring now more specifically to FIG. 4, illustrated therein is an alternate embodiment of device 10, wherein the alternate embodiment of FIG. 4 is substantially equivalent in form and function to that of the preferred embodiment detailed and illustrated in FIGS. 1–3 except as hereinafter specifically referenced. Specifically, the embodiment of FIG. 4 incorporates an additional divider 35 positioned and affixed between upper wall 26 and lower wall 28 of housing 20, thus creating third compartment 39 in which an additional two life vests may be stackingly arranged and stored. Such a configuration permits a total of six life vests to be stored within housing 20, and/or a plurality/combination of various personal floatation devices and/or other desired articles such as, for exemplary purposes only, fishing equipment, blankets, clothing, safety kits, fishing belts, fishing nets, and/or the like.

Figure 5:
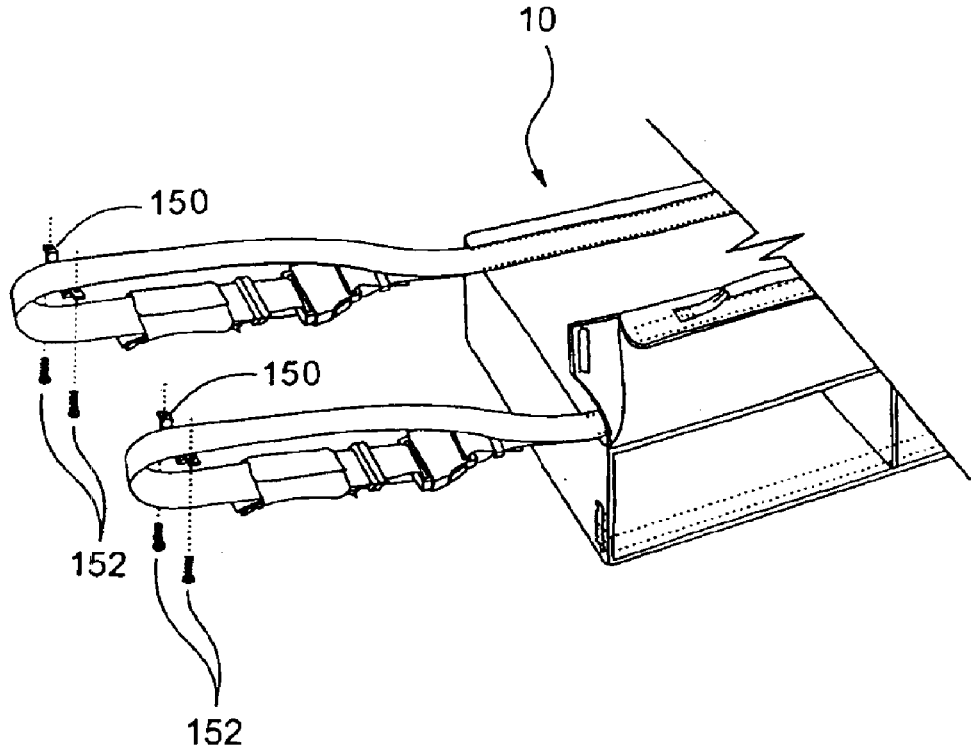
FIG. 5 is a perspective view of an apparatus for storing and accessing personal floatation devices and/or other articles according to an alternate embodiment of the present invention.

Referring now more specifically to FIG. 5, illustrated therein is an alternate embodiment of device 10, wherein the alternate embodiment of FIG. 5 is substantially equivalent in form and function to that of the preferred embodiment detailed and illustrated in FIGS. 1–3 except as hereinafter specifically referenced. Specifically, the embodiment of FIG. 5 utilizes brackets 150 and associated bolts 152 to attach device 10 to a hard surface via feeding respective ends of first strap 82 and third strap 94 through surface secured brackets 150, and thereafter cooperatively engaging male fastening mechanisms 86, 88, 98 and 100 to respective female fastening mechanisms 90, 92, 102 and 104. Brackets 150 are preferably of sufficient size to permit the introduction and/or removal of male fastening mechanisms 86, 82, 98 and 100 therefrom, thus facilitating overall removal of device 10 from the mounting surface. Although bolts 152 are preferably utilized to fasten brackets 150 to a hard surface of the aquatic vessel, other fastening mechanisms could be utilized, such as, for exemplary purposes only, screws, rivets, and/or the like.

Figure 6:
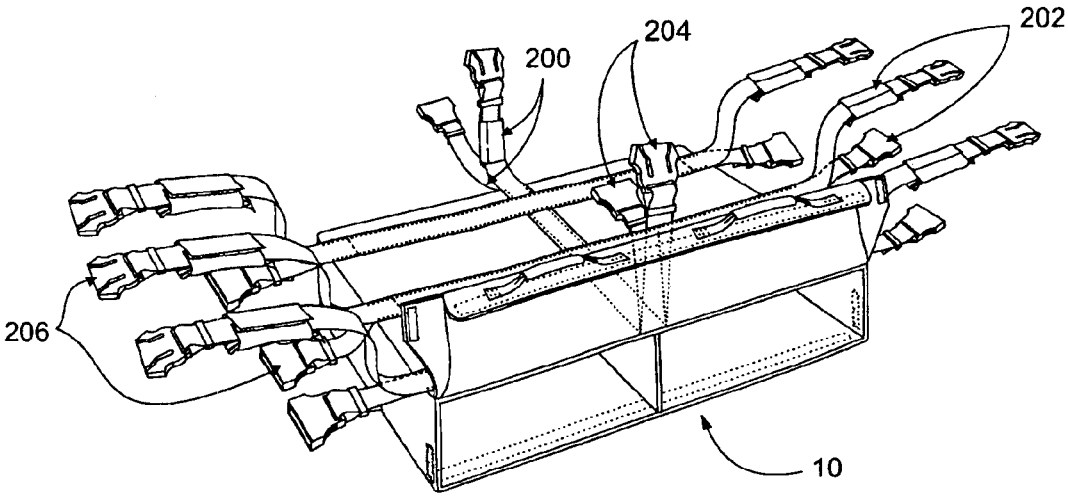
FIG. 6 is a perspective view of an apparatus for storing and accessing personal floatation devices and/or other articles according to an alternate embodiment of the present invention; and, FIG. 7 is a perspective view of an apparatus for storing and accessing personal floatation devices and/or other articles according to an alternate embodiment of the present invention.

Referring now more specifically to FIG. 6, illustrated therein is an alternate embodiment of device 10, wherein the alternate embodiment of FIG. 6 is substantially equivalent in form and function to that of the preferred embodiment detailed and illustrated in FIGS. 1–3 except as hereinafter specifically referenced. Specifically, the embodiment of FIG. 6 incorporates additional straps 200, 202, 204 and 206 having respective female and male fastening mechanisms. The additional straps 200, 202, 204 and 206 permit device 10 to be attached to other surrounding bars and/or structures of boat B, thus further stabilizing and/or supporting device 10 in a user-specified location.

Figure 7:
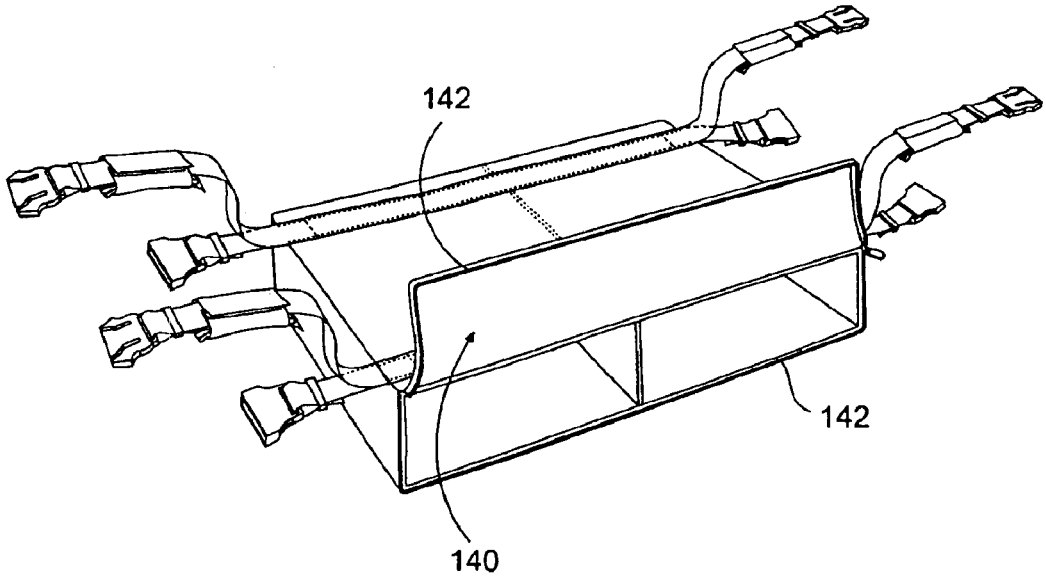

Referring now more specifically to FIG. 7, illustrated therein is an alternate embodiment of device 10, wherein the alternate embodiment of FIG. 7 is substantially equivalent in form and function to that of the preferred embodiment detailed and illustrated in FIGS. 1–3 except as hereinafter specifically referenced. Specifically, the embodiment of FIG. 7 incorporates closure flap 140, wherein closure flap 140 differs from closure flap 40, as described above, via the utilization of zipper mechanism 142, thus replacing use of lip 44, hook-and-loop fastening mechanism 46, side flaps 45 and 47, and hook-and-loop fastening mechanisms 41 and 51, as the preferred closure means of aperture 22 of housing 20.

It is contemplated in an alternate embodiment that device 10 could utilize hook-and-loop fastening mechanisms to releasably attach to the vessel's structure, thus eliminating the use of securing straps.

It is contemplated in an alternate embodiment that device 10 could utilize ridge-and-channel or slide-and-rail mechanisms to slidably and releasably attach to the vessel's structure, thus eliminating the use of securing straps.

It is contemplated in an alternate embodiment that device 10 could possess any number of straps and/or buckles to assist in supporting device 10 in a user-specified position.

It is contemplated in an alternate embodiment that device 10 could manufactured to any size and/or shape to accommodate any type and/or number of personal floatation devices and/or personal articles.

It is contemplated in an alternate embodiment that device 10 could be manufactured to possess a plurality of external and/or internal pockets to facilitate the retention of a variety of articles therein.

It is contemplated in an alternate embodiment that device 10 could possess an external and/or internal elastic retaining strap to facilitate the retention of a variety of articles therein.

It is contemplated in an alternate embodiment that device 10 could possess an external and/or internal mesh hammock to facilitate the retention of a variety of articles therein.

It is contemplated in an alternate embodiment that rear wall 24 of device 10 could also be removable to permit access to items contained within housing 20 from either aperture 22 or removable rear wall 24.

It is contemplated in an alternate embodiment that device 10 could possess any number of apertures and/or removable walls to permit access to items contained therewithin.

It is contemplated in an alternate embodiment that device 10 could possess any number and type of reinforcing mechanisms positioned at select, or all, corners, side and/or edges of housing 20, wherein such reinforcing mechanisms could include, but are not limited to, additional straps, webbing, riveting, additional stitching, fabric reinforced edges, and/or the like.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A storage device for use on an aquatic vessel having a deck, said storage device comprising:

at least one housing dimensioned to receive at least one personal floatation device, said at least one housing comprising a fixed floor for supporting the at least one personal floatation device; and, a securing means for adapting and maintaining said at least one housing to a user-selected structure of the aquatic vessel such that said fixed floor is disposed approximately parallel to the deck of the aquatic vessel, wherein said securing means is at least one strap having at least one adjustable buckle mechanism.

2. The storage device of claim 1, wherein said at least one housing is compartmentalized.

3. The storage device of claim 1, wherein said at least one housing is dimensioned to receive a plurality of floatation devices.

4. The storage device of claim 1, wherein said at least one housing comprises at least one closure flap.

5. The storage device of claim 4, wherein said at least one closure flap comprises at least one hook-and-loop fastening mechanism.

6. The storage device of claim 4, wherein said at least one closure flap comprises at least one zipper mechanism.

7. The storage device of claim 4, wherein said at least one closure flap comprises at least one handle.

8. The storage device of claim 1, wherein said securing means is at least one hook-and-loop fastening mechanism for adapting and maintaining said at least one housing in an elevated position to a user-selected structure of the aquatic vessel.

9. A storage device for adaptation to an overhead covering of an aquatic vessel having a deck, said storage device comprising:

a housing dimensioned to receive at least one personal floatation device, said housing comprising a fixed floor for supporting the at least one personal floatation device; and, means for securing said housing to the overhead covering of the aquatic vessel such that said fixed floor is disposed approximately parallel to the deck of the aquatic vessel, wherein said securing means is at least one hook-and-loop fastening mechanism.

10. The storage device of claim 9, wherein said housing is compartmentalized.

11. The storage device of claim 9, wherein said housing is dimensioned to receive a plurality of floatation devices.

12. The storage device of claim 9, wherein said housing comprises at least one closure flap.

13. The storage device of claim 12, wherein said at least one closure flap comprises at least one hook-and-loop fastening mechanism.

14. The storage device of claim 12, wherein said at least one closure flap comprises at least one zipper mechanism.

15. The storage device of claim 12, wherein said at least one closure flap comprises at least one handle.

16. The storage device of 9, wherein said securing means is at least one strap having at least one adjustable buckle mechanism.

* * * * *